US010330399B2

(12) United States Patent
Dimmer et al.

(10) Patent No.: US 10,330,399 B2
(45) Date of Patent: Jun. 25, 2019

(54) HEAT EXCHANGER AND HEAT EXCHANGER TANK

(71) Applicant: Modine Manufacturing Company, Racine, WI (US)

(72) Inventors: Eric Dimmer, Racine, WI (US); John Kis, Kansasville, WI (US)

(73) Assignee: MODINE MANUFACTURING COMPANY, Racine, WI (US)

( * ) Notice: Subject to any disclaimer, the term of this patent is extended or adjusted under 35 U.S.C. 154(b) by 4 days.

(21) Appl. No.: 15/574,575

(22) PCT Filed: May 20, 2016

(86) PCT No.: PCT/US2016/033440
§ 371 (c)(1),
(2) Date: Nov. 16, 2017

(87) PCT Pub. No.: WO2016/191251
PCT Pub. Date: Dec. 1, 2016

(65) Prior Publication Data

US 2018/0128556 A1 May 10, 2018

Related U.S. Application Data

(60) Provisional application No. 62/165,596, filed on May 22, 2015.

(51) Int. Cl.
*F28F 9/02* (2006.01)
*F28F 9/007* (2006.01)
(Continued)

(52) U.S. Cl.
CPC ..... *F28F 9/0224* (2013.01); *F01M 5/002* (2013.01); *F28D 1/0366* (2013.01);
(Continued)

(58) Field of Classification Search
CPC ..... F28D 1/0399; F28D 7/0066; F01M 5/002; F28F 9/0224; F28F 9/002; F28F 9/0075;
(Continued)

(56) References Cited

U.S. PATENT DOCUMENTS 2,912,749 A 11/1959 Bauernfeind et al.
4,856,581 A 8/1989 Santoro
(Continued)

FOREIGN PATENT DOCUMENTS

DE 20208748 U1 10/2003
JP 2593516 Y2 2/1999
(Continued)

OTHER PUBLICATIONS

International Search Report and Written Opinion for Application No. PCT/US2016/033440 dated Aug. 23, 2016 (14 pages).
(Continued)

*Primary Examiner* — Davis D Hwu
(74) *Attorney, Agent, or Firm* — Michael Best & Friedrich LLP; Jeroen Valensa; Michael Bergnach

(57) ABSTRACT

A heat exchanger has a rectangular-shaped core having a plurality of fluid passages extending in a width direction and air fins interleaved between said fluid passages. The heat exchanger has tanks that define fluid manifolds located at opposite ends of the core and fluidly connected by the plurality of fluid passages between the tanks. The tanks each include an extruded tank section with open ends and end caps that enclose the ends of the extruded tank section. The tanks are assembled and attached to the core such that each of the end caps is located at each of four corners of the rectangular-shaped core.

4 Claims, 5 Drawing Sheets

(51) Int. Cl.

| | |
|---|---|
| ***F28F 9/26*** | (2006.01) |
| ***F28D 1/03*** | (2006.01) |
| ***F28D 7/00*** | (2006.01) |
| ***F01M 5/00*** | (2006.01) |
| ***F28F 9/00*** | (2006.01) |

(52) U.S. Cl.
CPC ..... *F28D 7/0066* (2013.01); *F28F 9/002* (2013.01); *F28F 9/0075* (2013.01); *F28F 9/02* (2013.01); *F28F 9/0221* (2013.01); *F28F 9/262* (2013.01); *F28F 2220/00* (2013.01); *F28F 2265/30* (2013.01)

(58) Field of Classification Search
CPC .. F28F 9/02; F28F 9/0221; F28F 9/262; F28F 2220/00; F28F 2265/30
USPC ..... 165/173
See application file for complete search history.

(56) References Cited

U.S. PATENT DOCUMENTS

| | | | |
|---|---|---|---|
| 4,928,755 | A | 5/1990 | Doty et al. |
| 5,535,819 | A | 7/1996 | Matsuura |
| 5,975,197 | A | 11/1999 | Kado |
| 6,273,182 | B1 | 8/2001 | Pautler et al. |
| 7,059,050 | B2 | 6/2006 | Calhoun et al. |
| 7,152,669 | B2 | 12/2006 | Kroetsch et al. |
| 7,195,060 | B2 | 3/2007 | Martin et al. |
| 8,371,366 | B2 | 2/2013 | Higashiyama et al. |
| 2002/0084064 | A1 | 7/2002 | Rhodes et al. |
| 2008/0156455 | A1 | 7/2008 | Powers et al. |
| 2009/0050298 | A1 | 2/2009 | Takahashi |
| 2009/0229800 | A1 | 9/2009 | Bhatti et al. |
| 2010/0300664 | A1 | 12/2010 | Kang et al. |
| 2012/0118544 | A1 | 5/2012 | Ciaffarafa et al. |
| 2013/0140010 | A1 | 6/2013 | Parfenov |
| 2014/0290920 | A1 | 10/2014 | Ouradnik et al. |

FOREIGN PATENT DOCUMENTS

| | | | |
|---|---|---|---|
| JP | 2003-097895 | A | 4/2003 |
| JP | 2004-169953 | A | 6/2004 |
| KR | 20140118878 | A | 10/2014 |

OTHER PUBLICATIONS

Notification of the First Office Action for Chinese Patent Application No. 2016800294553, The State Intellectual Property Office of the People's Republic of China dated Jan. 4, 2019 (8 pages).
Notice of Preliminary Rejection for Korean Patent Application No. 10-2017-7031366, Korea Intellectual Property Office dated Jan. 10, 2019 (9 pages).

HEAT EXCHANGER AND HEAT EXCHANGER TANK

CROSS-REFERENCE TO RELATED APPLICATIONS

This application claims priority to U.S. Provisional Patent Application No. 62/165,596, filed on May 22, 2015, the entire contents of which are hereby incorporated by reference.

BACKGROUND

Heat exchangers are used to transfer thermal energy from one stream of fluid at a first, higher temperature to another stream of fluid at a second, lower temperature. Oftentimes such heat exchangers are used to remove waste heat from a process fluid such as oil, coolant, or the like by transferring that heat to a flow of cooler air directed to pass through the heat exchanger.

In certain applications, the process fluid to be cooled is also at an operating pressure that is substantially greater than the ambient atmospheric pressure of the heat exchanger's surroundings. As a result, it becomes necessary for the heat exchanger to be designed to withstand the pressure forces that result from the process fluid passing through the heat exchanger. This can become challenging, especially in cases where the heat exchanger is to be used in large systems and machinery such as, for example, construction equipment, agricultural machines, and the like. As the size of the machine or system increases, the flow rate of the process fluid also increases, necessitating larger heat exchangers to accommodate both the heat transfer requirements and the fluid flow rates. Such larger heat exchangers can have substantially large surface areas exposed to the pressure of the process fluid, especially in tank areas, and the force of the fluid pressure acting on these large surfaces can lead to destructive mechanical stresses in the heat exchanger structure.

An example of such a heat exchanger as known in the art is depicted in FIG. 1. The heat exchanger 101 is of a bar and plate construction, and can be used as, for example, an oil cooler for an off-highway vehicle such as an excavator, wheel loader, combine, etc. Oil to be cooled by the heat exchanger 101 travels through a plurality of channels provided within a heat exchanger core 102, those channels alternating with channels for cooling air that is directed in a cross-flow orientation to the oil through the core 102. Tanks 103 are provided at either end of the core 102 to direct the oil to and from the core 102, and inlet/outlet ports 106 are provided at each of the tanks 103 to fluidly couple the heat exchanger 101 to the oil circuit.

The tanks 103 must be sized to be large enough to evenly distribute the flow of oil to the individual channels. As a result, substantially large surface areas within the tank are exposed to the typically high pressure of the oil, and must be designed to be capable of withstanding such forces. A typical tank construction for such high-pressure applications includes an extruded tank section 104 with an arcuate (e.g. cylindrical) internal profile in order to evenly distribute the forces resulting from the pressure loading. Flat end caps 105 are welded to the ends of the extruded tank section 104 in order to close off the ends of the tank 103. Those flat end caps 105 must again be designed with a thickness that is suitable for withstanding the pressure forces imposed on them by the fluid in the tank 103. Such a tank construction can be more economical than a tooled cast tank for low-volume manufacturing.

Even when such heat exchangers have been designed with wall sections suitable for withstanding the elevated operating pressure of the intended application, the forces acting on the end caps can result in undesirable and damaging stresses in the remainder of the heat exchanger. Thus, there is still room for improvement.

SUMMARY

According to an embodiment of the invention, a heat exchanger includes a rectangular shaped core having fluid passages extending therethrough in a width direction, and air fins interleaved between the fluid passages. Tank end caps are arranged at each of four corners of the core. First and second extruded tank sections are arranged at ends of the core in the width direction, with the first extruded tank section extending between and joined to a first and second one of the tank end caps and the second extruded tank section extending between and joined to a third and fourth one of the tank end caps. The first extruded tank section and first and second tank end caps together define a first fluid manifold and the second extruded tank section and third and fourth tank end caps together define a second fluid manifold. The fluid passages provide fluid communication between the first and second fluid manifolds.

In some embodiments, at least one of the fluid passages extends between a portion of the first fluid manifold defined by one of the first and second end caps and a portion of the second fluid manifold defined by one of the third and fourth end caps.

In some embodiments the first, second, third and fourth tank end caps are all identical and interchangeable parts.

In some embodiments each one of the tank end caps provides a corner mounting feature of the heat exchanger.

According to another embodiment of the invention, a tank end cap for a heat exchanger includes a first open planar face having a generally rectangular shape, and a second open planar face oriented perpendicular to the first open planar face, with the first and second faces sharing a common edge. The second open planar face has a generally semicircular shape. An internal volume is bounded by the first and second open planar faces.

In some embodiments the tank end cap is cast from an aluminum alloy. In some other embodiments the tank end cap includes a mounting aperture that extends through the tank end cap.

DETAILED DESCRIPTION

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 2:
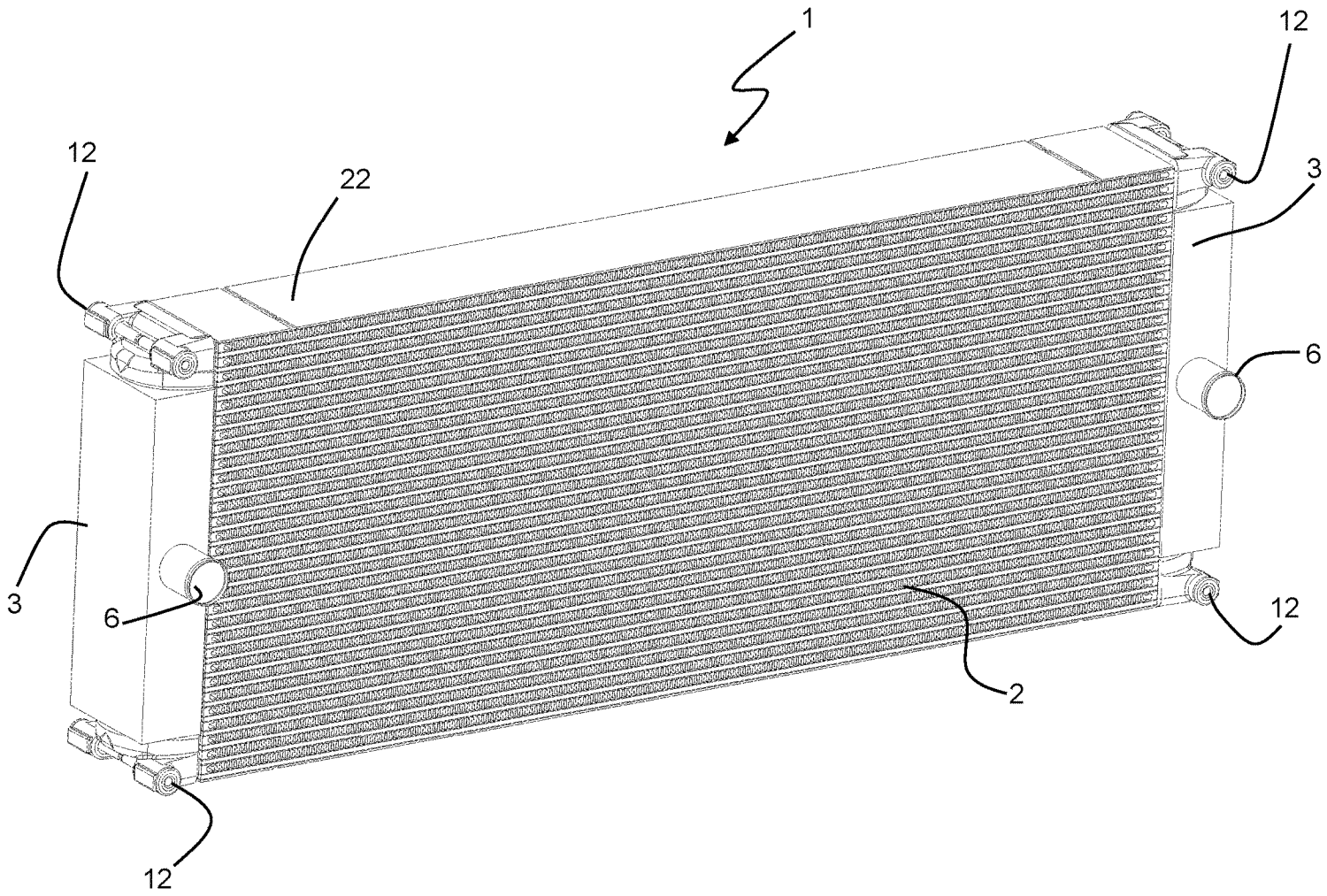
FIG. 2 is a perspective view of a heat exchanger according to an embodiment of the invention.

A heat exchanger 1 embodying the present invention is shown in FIG. 2, and can provide durability advantages over other known heat exchangers when used in high-pressure applications such as oil cooling, engine coolant cooling, charge-air cooling, and the like. For purposes of description, reference will be made to the heat exchanger 1 as being an air-cooled oil cooler to be used for the cooling of engine oil, but it should be understood that the invention can find applicability in other heat exchanger applications as well.

Figure 3:
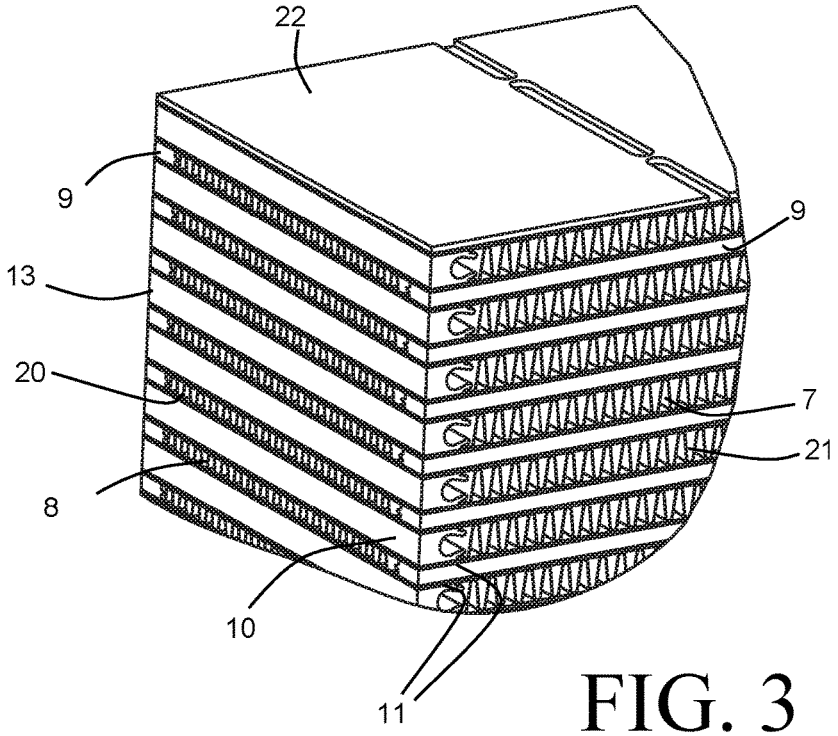
FIG. 3 is a partial perspective view of a core of the heat exchanger of FIG. 2.

The heat exchanger 1 is of a bar-plate construction, and includes a brazed heat exchanger core 2 defining alternating passages for the flow of oil and cooling air. As best seen in FIG. 3, the core 2 is formed by stacking flat separator plates 11 spaced apart alternatingly by long bars 9 and short bars 10 to define alternating oil passages 8 and air passages 7. The oil passages 8, bounded by long bars 9 arranged at opposing air inlet and outlet faces of the heat exchanger 1, extend in the heat exchanger width direction. The air passages 7, bounded by short bars 10 arranged at opposing tank ends of the heat exchanger 1, extend in the heat exchanger depth direction, so that the oil passages 8 and air passages 7 are arranged to be perpendicular to one another, resulting in a cross-flow heat exchange orientation. Oil inserts 20 are arranged between the separator plates 11 in the oil passages 8, and air fins 21 are arranged between the separator plates 11 in the air passages 7. The oil inserts 20 and air fins 21 provide heat transfer enhancement through additional heat exchange surface area and flow turbulation for their respective fluids, as well as provide structural support to the separator plates in order to withstand the pressurization forces imposed by the fluids. The core 2 is bounded by side plates 22 at both the top and bottom ends of the stack.

Figure 4:
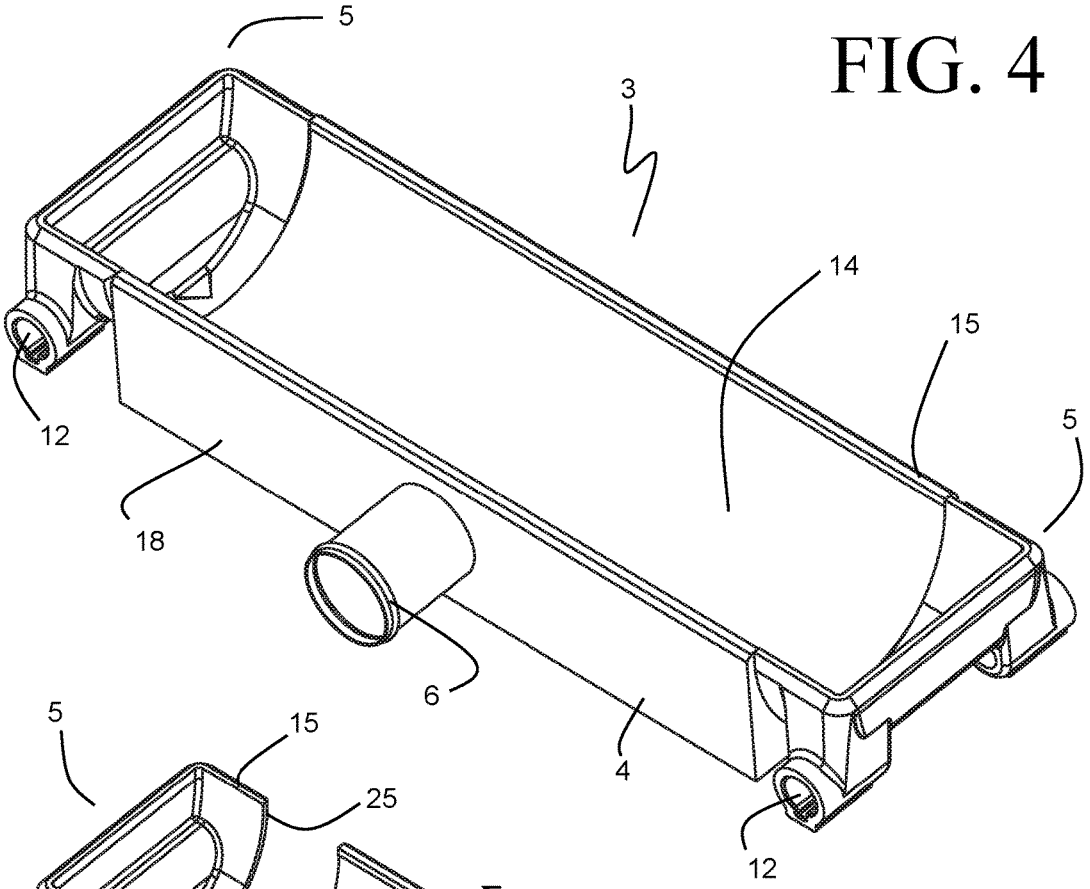
FIG. 4 is a perspective view of a tank to be used in the heat exchanger of FIG. 2 according to some embodiments of the invention.
Figure 5:
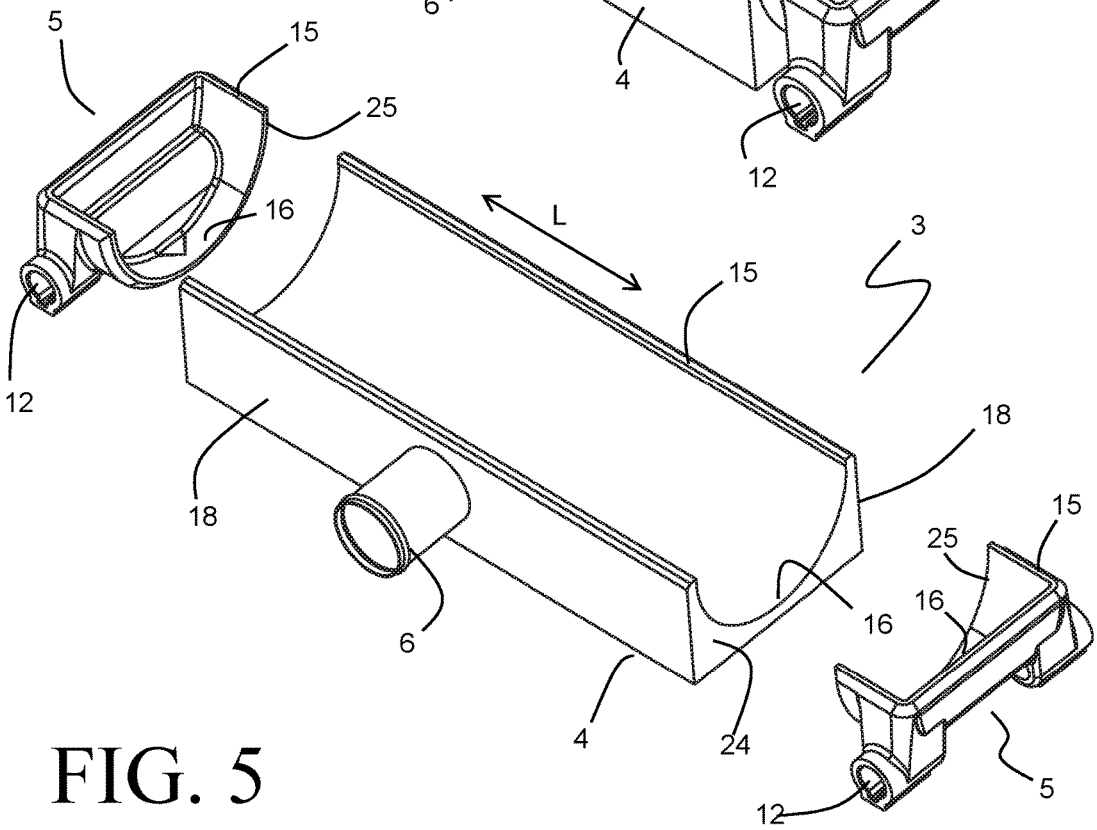
FIG. 5 is an exploded perspective view of the tank of FIG. 4.
Figure 6B:
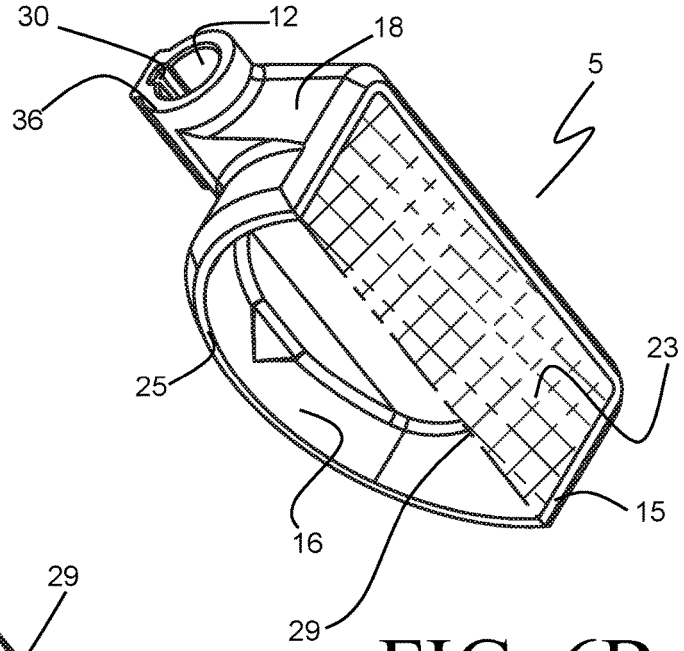
FIGS. 6A and 6B are perspective views of an end cap portion of the tank of FIG. 4.
Figure 6A:
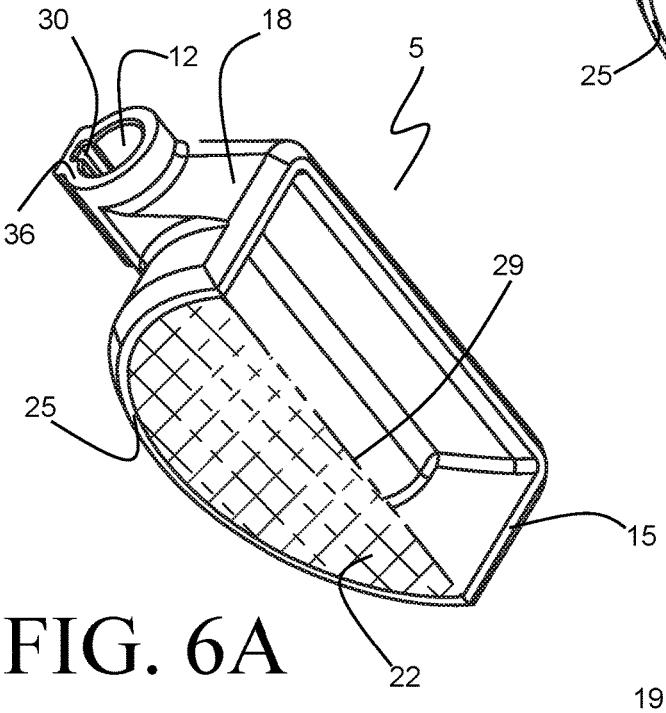

Flat sides of the short bars 10, ends of the long bars 9, and edges of the separator plates 11 and side plates 12 together form a generally planar wall 13 at each tank end of the core 2. Inlet and outlet tanks 3 are welded or otherwise joined to the walls 13 to provide inlet and outlet manifolding for the oil flowing through the oil passages 8. A representative tank 3 is shown in FIGS. 4-5, and will be described in greater detail with reference to those figures and FIGS. 6-8.

Figure 7:
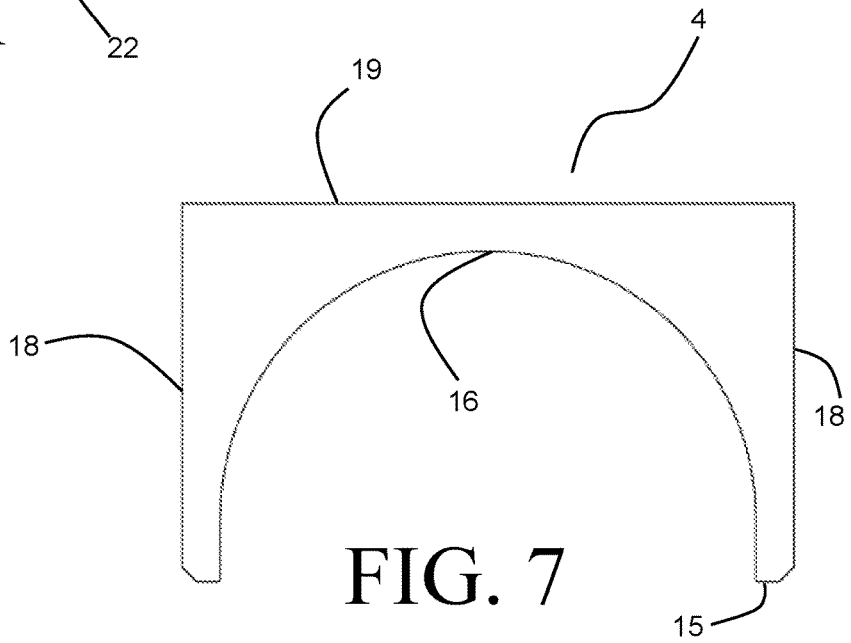
FIG. 7 is a plan view showing an extrusion profile used in the tank of FIG. 4.

In order to withstand the elevated pressure forces imposed by the oil or other pressurized fluid traveling through the heat exchanger 1, the tank 3 is formed as a welded assembly, preferably of an aluminum alloy, although other metals could be substituted as required for the application. The tank 3 is of a generally box-like construction, with three of the sides provided by an extruded tank section 4, the profile of which is shown in FIG. 7. The extruded tank section 4 extends in a longitudinal direction (indicated by the double-ended arrow labeled "L" in FIG. 5) and includes a pair of opposing sides 18 spaced apart to define a tank width approximately equal to the depth of the heat exchanger core 2, joined by a third side 19 to form the outer perimeter of the box-like tank. A fluid inlet or outlet port 6 extends through one of the side walls 18, although such a port 6 could alternatively extend through the side wall 19. A cylindrical surface 16 is provided in the interior of the tank section 4 and extends along the length direction L so that internal pressure forces are resolved primarily as membrane stresses in the tank section 4, rather than as bending stresses. Such a configuration can provide enhanced durability to the tank 3 when the fluid passing through the channels 8 of the heat exchanger 1 is at a pressure that is substantially elevated over the ambient pressure.

The ends 24 of the extruded tank section 4 are capped by a pair of end caps 5. The end caps 5 are preferably cast components of a similar alloy as the extruded tank section 4, so that the completed tank 3 can be manufactured by metallurgically joining the tank section 4 and the end caps 5 (by welding, for example). Such joining of the end caps 5 to the section 4 results in a tank 3 having an internal volume 14 to provide for the requisite manifolding of the oil or other fluid.

The end cap 5 has a first open face 22 (illustrated in cross-hatched fashion in FIG. 6A) which generally complements the extrusion profile of the tank 4. As such, the face 22 is defined by a semi-circular arcuate edge, so that the cylindrical surface 16 continues for some length into the end cap 5. The face 22 is bounded by an edge 25 which can be disposed directly abutting an end face 24 of the extruded tank section 4, and a weld joint can be created along the edge 25 in order to join the end cap 5 to that end face 24.

The tank 3 has a generally rectangular peripheral edge 15 that bounds the open end of the tank and that is joined (by welding, for example) to a face 13 of the heat exchanger core 2 in order to provide a fluid-tight seal between the tank and the face 13. The rectangular peripheral edge 15 includes two long edges spaced apart by a distance corresponding to the heat exchanger depth, and two relatively short edges spaced apart by a distance corresponding to the total heat exchanger height (i.e. the distance between the opposing side plates 22). Each of the end caps 5 defines one of the short edges of the peripheral edge 15 and end portions of each of the two long edges of the peripheral edge 15. As a result, the end cap 5 has a second open face 23 (illustrated in cross-hatched fashion in FIG. 6B) defined by those portions of the peripheral edge 15.

The first open face 22 and the second open face 23 are oriented perpendicular to one another and share a common edge 29. It should be understood that the open faces 22 and 23 are not physical faces of the end cap 5, but rather represent fluid boundaries of the end cap 5. Furthermore, the common edge 29 of the faces 22 and 23 is not a physical edge, but is rather the intersection line of the two fluid boundaries represented by the open faces 22 and 23. A portion of the tank internal volume 14 is thus contained within each of the end caps 5, and is bounded by those open faces 22 and 23.

By extending the cylindrical surface 16 of the tank 3 into the end caps 5 at either end of the tank 3, the extruded tank section 4 has a length in the extrusion direction (indicated as "L" in FIG. 5) that is somewhat less than the total height of the heat exchanger 1. The amount by which the length of the tank section 4 is less than that total heat exchanger height is defined by the extents of those portions of the long edges of the peripheral edge 15 provided by the end caps 5. It is preferable that at least the outermost ones of the oil passages 8 open into a portion of the tank 3 that is defined by the end caps 5. In other words, the dimension of the end cap 5 in the heat exchanger height direction is preferably at least equal to the combined height of a short bar 10 and a long bar 9. Even more preferably, the end cap 5 has a dimension in that direction which is at least three times that amount, so that at least the outermost three or more oil passages 8 at each end of the heat exchanger open into a portion of the tank 3 that is defined by the end caps 5.

Figure 1:
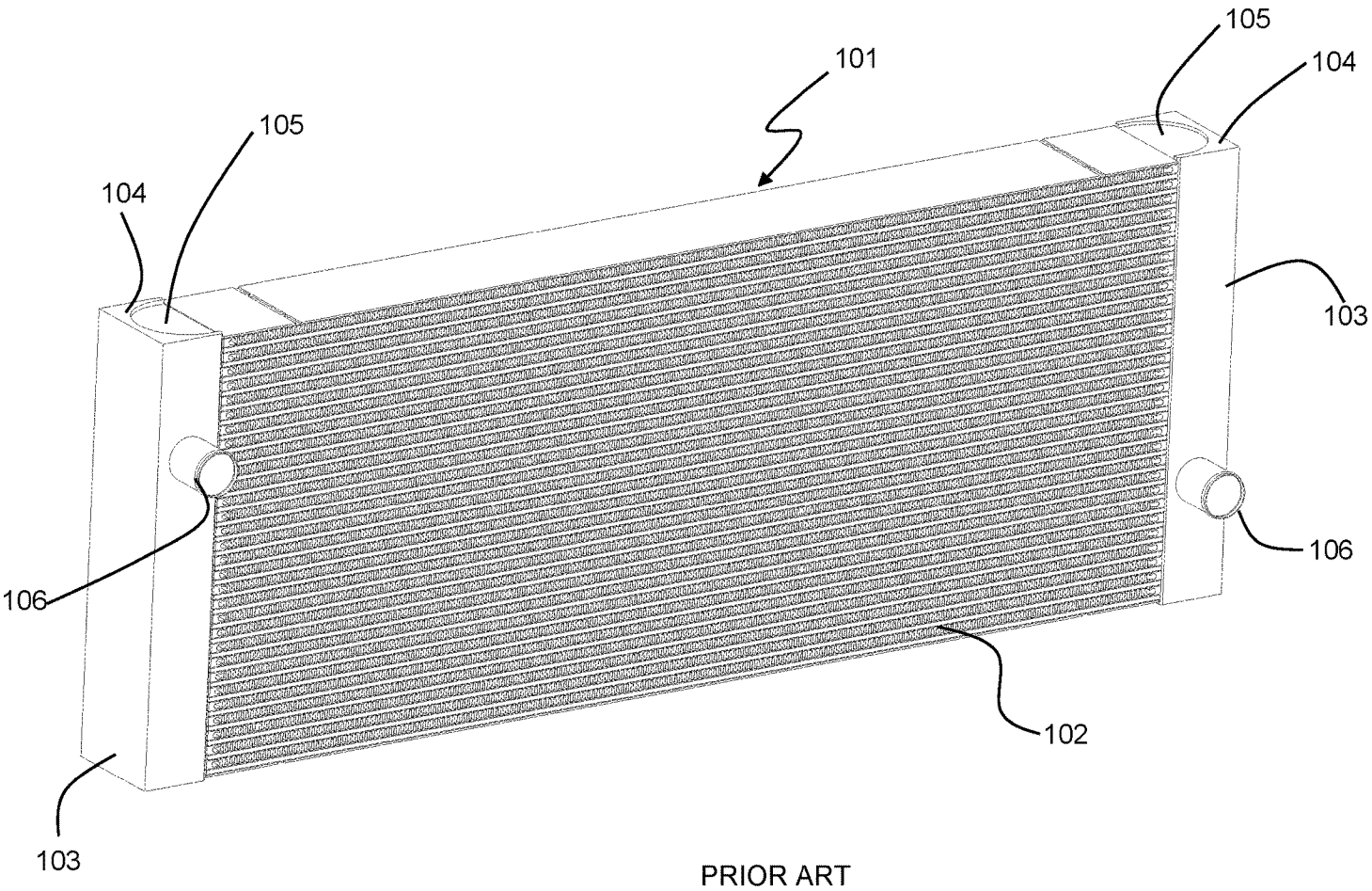
PRIOR ART FIG. 1
FIG. 1 is a perspective view of a prior art heat exchanger.

Oil coolers, radiators, charge-air coolers, and other heat exchangers similar in construction to the heat exchanger 101 of FIG. 1 are known to be prone to failure resulting from elevated fluid pressure within the tanks 103. Such failures are typically manifested at the ends of the tanks, where the planar caps 105 are subjected to deformation caused by the elevated pressures. In contrast, the cast end cap 5 of the present invention is believed to provide improved structural reinforcement at the ends of the tank 3 in order to ameliorate this pressure sensitivity.

Figure 8:
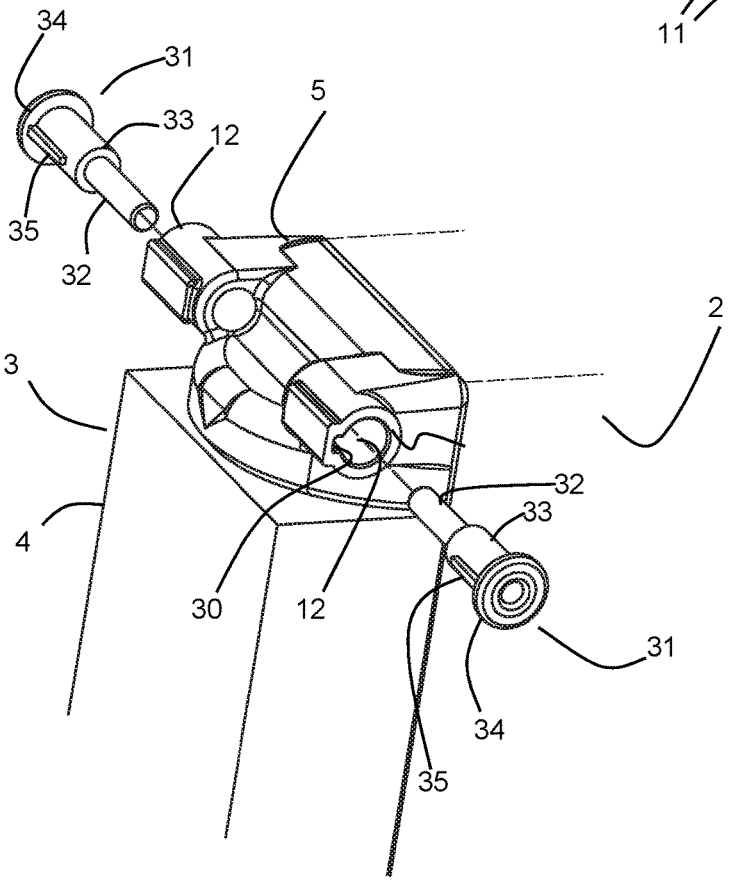
FIG. 8 is a partial perspective view of a tank to be used in the heat exchanger of FIG. 2 according to some embodiments of the invention.

Mounting features 12 can be advantageously incorporated into the tank ends 5 in order to provide the heat exchanger 1 with structural mounting locations at each of the four corners. In the exemplary embodiment depicted in the figures, the mounting features 12 include a cylindrical aperture that extends through the end cap 5 in the depth direction of the heat exchanger. Mounting isolators 31 can be inserted into the aperture from both ends, as shown in FIG. 8. Such mounting isolators 31 allow for secure structural attachment of the heat exchanger 1 using bolts or the like (not shown) while simultaneously preventing or dampening the transmission of undesirable shocks and/or vibrations to the heat exchanger 1.

The isolator 31 can be constructed of a rigid core 32 fabricated of steel or other metal alloy, surrounded over a portion of its length by an over-molded elastomeric sleeve 33. The rigid core 32 has a hollow cylindrical shape, and is sized to permit the passage therethrough of a threaded bolt or similar fastener. The elastomeric sleeve 33 is of a shape and size that closely corresponds to the geometry of the aperture 12, so that the isolator 31 can be securely received therein. An anti-rotational protrusion 35 can be provided on the elastomeric sleeve 33 and be received within a corresponding slot feature 30 of the end cap 5, so that rotation of the isolator 31 within the end cap 5 is prevented. The isolator 31 terminates in a cap portion 34 of the elastomeric sleeve 33, which is disposed against a seating surface 36 of the end cap 5 upon insertion of the isolator 31.

The rigid core 32 of the isolator 31 allows for a secure fastening of the heat exchanger 1 into a vehicular frame or other system. Such secure mounting is especially necessary when the heat exchanger 1 is of a relatively large size and, therefore, has substantial weight due to the large volume of liquid that can be contained within the tank 3 and the fluid passages 8. Vibrations (such as may be generated by an engine that is present within the vehicle or system) are damped by the elastomeric sleeves 33, so that the transmission of those undesirable vibrations to the heat exchanger 1 is reduced. This reduction in transmission of vibrations can lead to an enhanced durability life of the heat exchanger 1.

Preferably, the end cap 5 is a bilaterally symmetrical part, so that a common part can be used at each of the four corners of the heat exchanger 1. Accommodating such use of a single part provides economies of scale and reduces the overall cost of the heat exchanger 1. Furthermore, a common end cap 5 can be used for heat exchangers of varying heights, as the length of the tank 3 can be easily modified by adjusting the length to which the extruded tank section 4 is cut. This allows for great flexibility in heat exchanger sizing, as the overall height of the heat exchanger 1 is otherwise easily varied by increasing or decreasing the number of layers of fluid passages 7, 8.

Various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

We claim:

1. A heat exchanger comprising:

a rectangular shaped core having a plurality of fluid passages extending therethrough in a width direction and air fins interleaved between said fluid passages;

tank end caps arranged at each of four corners of the rectangular shaped core;

a first extruded tank section arranged at a first end of the core in the width direction, the first extruded tank section extending between and joined to a first and second one of the tank end caps; and a second extruded tank section arranged at a second end of the core in the width direction opposite the first end, the second extruded tank section extending between and joined to a third and fourth one of the tank end caps, wherein the first extruded tank section and first and second tank end caps together define a first fluid manifold and the second extruded tank section and third and fourth tank end caps together define a second fluid manifold, the plurality of fluid passages providing for fluid communication between the first and second fluid manifolds;

wherein the first extruded tank section includes an interior cylindrical surface that extends in a length direction of the first extruded tank section to a first end face and an opposite second end face to define semi-circular openings in the first and second end faces and wherein the first and second tank end caps each include an interior cylindrical surface that extends to a cap face defining a semi-circular edge, wherein the semi-circular edge of the first tank end cap is aligned with the semi-circular opening of the first end face and the semi-circular edge of the second tank end cap is aligned with the semi-circular opening of the second end face to form a tank;

wherein the cap face of the first tank end cap engages the first end face and the cap face of the second tank end cap engages the second end face; and wherein each of the first tank end cap and the second tank end cap includes a semi-circular tapered edge, wherein the semi-circular tapered edges extend away from the end faces of the first extruded tank section to provide a gap between the end faces of the first extruded tank section and the first and second tank end caps.

2. A heat exchanger comprising:

a rectangular shaped core having a plurality of fluid passages extending therethrough in a width direction and air fins interleaved between said fluid passages;

tank end caps arranged at each of four corners of the rectangular shaped core;

a first extruded tank section arranged at a first end of the core in the width direction, the first extruded tank section extending between and joined to a first and second one of the tank end caps; and a second extruded tank section arranged at a second end of the core in the width direction opposite the first end, the second extruded tank section extending between and joined to a third and fourth one of the tank end caps, wherein the first extruded tank section and first and second tank end caps together define a first fluid manifold and the second extruded tank section and third and fourth tank end caps together define a second fluid manifold, the plurality of fluid passages providing for fluid communication between the first and second fluid manifolds;

wherein the first extruded tank section includes an interior cylindrical surface that extends in a length direction of the first extruded tank section to a first end face and an opposite second end face to define semi-circular openings in the first and second end faces and wherein the first and second tank end caps each include an interior cylindrical surface that extends to a cap face defining a semi-circular edge, wherein the semi-circular edge of the first tank end cap is aligned with the semi-circular opening of the first end face and the semi-circular edge of the second tank end cap is aligned with the semi-circular opening of the second end face to form a tank;

wherein the core includes a wall surface at a tank end of the core that extends around the periphery of the tank end of the core, and wherein the tank includes a peripheral edge that engages the wall surface; and wherein the tank includes a bottom tapered edge adjacent to the peripheral edge that extends away from the tank end of the core to provide a gap between the tank and the wall surface.

3. A heat exchanger comprising:

a rectangular shaped core having a plurality of fluid passages extending therethrough in a width direction and air fins interleaved between said fluid passages;

tank end caps arranged at each of four corners of the rectangular shaped core;

a first extruded tank section arranged at a first end of the core in the width direction, the first extruded tank section extending between and joined to a first and second one of the tank end caps; and a second extruded tank section arranged at a second end of the core in the width direction opposite the first end, the second extruded tank section extending between and joined to a third and fourth one of the tank end caps, wherein the first extruded tank section and first and second tank end caps together define a first fluid manifold and the second extruded tank section and third and fourth tank end caps together define a second fluid manifold, the plurality of fluid passages providing for fluid communication between the first and second fluid manifolds;

wherein the first extruded tank section includes an interior cylindrical surface that extends in a length direction of the first extruded tank section to a first end face and an opposite second end face to define semi-circular openings in the first and second end faces and wherein the first and second tank end caps each include an interior cylindrical surface that extends to a cap face defining a semi-circular edge, wherein the semi-circular edge of the first tank end cap is aligned with the semi-circular opening of the first end face and the semi-circular edge of the second tank end cap is aligned with the semi-circular opening of the second end face to form a tank;

wherein the first and second tank end caps each include a cap end disposed opposite of the cap face, each of the cap ends having a recess;

wherein the first and second tank end caps each include at least one mounting feature; and wherein the at least one mounting feature includes two arms disposed around the recess.

4. The heat exchanger of claim 2, wherein the tank is welded to the core at the bottom taper edge.

* * * * *